US005240438A

United States Patent [19]

Desranleau et al.

[11] Patent Number: 5,240,438

[45] Date of Patent: Aug. 31, 1993

[54] ELECTRICAL OR ELECTRONICAL MOTOR CONTROL

[75] Inventors: Rejean Desranleau; Yvan Gingras, both of Quebec, Canada

[73] Assignee: Telemecanique Canada Ltee, Dorval, Canada

[21] Appl. No.: 716,394

[22] Filed: Jun. 17, 1991

[30] Foreign Application Priority Data

Apr. 10, 1991 [CA] Canada ..... 2040122

[51] Int. Cl.[5] ..... H01R 13/642

[52] U.S. Cl. ..... 439/678; 307/326

[58] Field of Search ..... 439/535, 92, 102, 106, 439/678; 307/10.1, 326; 361/179

[56] References Cited

U.S. PATENT DOCUMENTS

| | | | |
|---|---|---|---|
| 2,063,099 | 12/1936 | Loock . | |
| 2,938,190 | 5/1960 | Krehbiel | 439/678 X |
| 3,500,056 | 3/1970 | Riley | 439/102 X |
| 3,605,059 | 9/1971 | Lipinski et al. | 439/106 |
| 3,633,075 | 1/1972 | Hawkins . | |
| 4,105,899 | 8/1978 | Velosa | 307/326 X |
| 4,166,934 | 9/1979 | Marrero . | |
| 4,280,164 | 7/1981 | Kozek | 361/179 |
| 4,295,018 | 10/1981 | Borrelli . | |
| 4,336,418 | 6/1982 | Hoag . | |
| 4,842,551 | 6/1989 | Heimann . | |
| 4,918,258 | 4/1990 | Ayer . | |

*Primary Examiner*—Eugene F. Desmond

[57] ABSTRACT

An electrical or electronical motor control composed of a switch and of an electromechanical component, each chosen from a group of different types of respectively switches and electromechanical components. A switch and an electromechanical component together form a control box. In a preferred embodiment, the electromechanical component includes a universal multiple pin connector whereas the switch is provided with a complementary multiple pin connector and the connection between those connectors is such that only the appropriate pins required to produce the appropriate result for a particular switch/electromechanical component combination are activated.

5 Claims, 5 Drawing Sheets

ELECTRICAL OR ELECTRONICAL MOTOR CONTROL

FIELD OF THE INVENTION

The present invention relates to an improved electrical or electronical motor control composed of a switch and an electromechanical component.

DESCRIPTION OF PRIOR ART

Controls are commonly used in commercial and industrial plants to control the operation of various electrical motors. Such controls are composed of switches such as on/off push buttons types and/or rotary types and of electromechanical components or the like. However, since it is possible to connect a great number of different switches to different electromechanical components, the controls have to be wired differently depending on the switch kit and function desired. This wiring cannot be made in advance.

In the prior art, different examples of electrical devices and corresponding holding means have been shown, however, as far as the applicant is aware, none of the prior art discloses a simple and efficient electrical or electronical motor control such as disclosed in the present application.

For example, Hawkins U.S. Pat. No. 3,633,075 shows a compartmentalized cabinet installation for housing motor circuit controls on plug-in modules. The configuration disclosed is mainly used for the addition of further motor controls at a future date rather than helping the wiring of a switch to an electromechanical component.

Heinmann U.S. Pat. No. 4,842,551 discloses a modular connector assembly for a utility box. Despite the fact that this invention uses modular connectors, same is mainly concerned for restraining means for holding the cable inside the utility box.

Therefore, there is a significant need for an improved motor control designed for rapid assembly and disassembly of the components forming same.

SUMMARY OF THE PRESENT INVENTION

In accordance with the invention, an improved electric motor control is constructed from a relatively small number of modular components for rapid and easy assembly and/or disassembly. The device may comprise a switch chosen from a group of appropriate switches and an electromechanical component chosen from a group of appropriate electromechanical components for the purpose of controlling the electrical or electronical motor. The electromechanical component may be provided with an universal multiple pin connector whereas the switch may be provided with a complementary multiple pin connector. The wiring of the switch to a universal multiple pin connector is standard and is achieved at the factory whereas the wiring of the electromechanical component is also achieved at the factory knowing what type of switches will be used for a particular purpose. The connection between the two multiple pin connectors is such that only the appropriate connections are made for the particular switch/electromechanical component combination. By so doing, automatic wiring is achieved. This invention has numerous advantages since no wiring is necessary at the plant. Therefore, the final connection can be accomplished without the need for any special knowledge.

OBJECTS OF THE PRESENT INVENTION

An object of the present invention is to provide an electrical or electronical motor control which will reduce substantially the time necessary to assemble and wire same (for the client and the manufacturer).

Another object of the present invention is to provide an electrical motor or electronical control which is more compact and/or simple in construction.

Yet another object of the present invention is to provide an electrical or electronical motor control which will offer maximum protection against the hazards of faulty wiring.

In accordance with a general aspect of the present invention, there is provided an electric motor control means comprising in combination a first switch means, an electromechanical component means, and a first multiple pin connection means comprising a first multiple pin connector, and a second multiple pin connector, said first and second connectors being electrically connected respectively to said switch means and said electromechanical means, said second connector being complementary to said first connector, and wherein the connection of said first and said second connectors is unique such that only the appropriate pins of one of the pin connectors of the first multiple pin connections means are automatically electrically connected to the other pin connector of the first multiple pin connection means.

In accordance with the present invention, a multiple pin connection means may comprise a plurality of complimentary male and female elements, at least one male element having a configuration different from the configuration of the other male elements.

In accordance with a further aspect of the present invention, there is provided an electrical motor control means destined to achieve a predetermined function comprising in combination a first switch means, a second switch means, an electromechanical component means, a first multiple pin connection means comprising a first multiple pin connector and a second multiple pin connector, said first and second connectors being electrically connected respectively to said first switch means and said second switch means and a second multiple pin connection means comprising a third multiple pin connector and a fourth multiple pin connector, said third and fourth connectors being electrically connected respectively to said second switch means and said electromechanical means, said second connector being complementary to said first connector, said fourth connector being complementary to said third connector, wherein the connection of said first and said second connectors is unique such that only the appropriate pins of one of the pin connectors of the first multiple pin connection means are automatically electrically connected to the other pin connector of the first multiple pin connection means and wherein the connection of said third and said fourth connectors is unique such that only the appropriate pins of one of the pin connectors of the second multiple pin connection means are automatically electrically connected to the other pin connector of the second multiple pin connection means.

In accordance with a further particular aspect of the present invention, there is provided an electric motor control means destined to achieve a predetermined function comprising in combination a first switch means, a second switch means, an electromechanical component means, a first multiple pin connection means comprising a first multiple pin connector and a second multiple pin connector, said first and second connectors being electrically connected respectively to said first switch means and said second switch means and a second multiple pin connection means comprising a third multiple pin connector and a fourth multiple pin connector, said third and fourth connectors being electrically connected respectively to said second switch means and said electromechanical means, said second connector being complementary to said first connector, said fourth connector being complementary to said third connector, said first multiple pin connection means comprising a plurality of complementary male and female elements, at least one male element having a configuration different from the configuration of the other male elements of said first multiple pin connection means, said second multiple pin connection means comprising a plurality of complementary male and female elements, at least one male element having a configuration different from the configuration of the other male elements of said second multiple pin connection means, wherein the connection of said first and said second connectors is unique such that only the appropriate pins of one of the pin connectors of the first multiple pin connection means are automatically electrically connected to the other pin connector of the first multiple pin connection means, and wherein the connection of third second and said fourth connectors is unique such that only the appropriate pins of one of the pin connectors of the second multiple pin connection means are automatically electrically connected to the other pin connector of the second multiple pin connection means.

In accordance with the present invention, a connection means may have a plurality of male elements. The plurality of male elements may comprise three groups of male elements, each of the groups of male elements comprising one or more male elements having the same configuration, the said same configuration being different from the configuration of the male elements of the other groups thereof.

In accordance with the present invention, there is provided an electric motor control means, wherein said first connector comprises said male elements and said second connector comprises said female elements.

Also in accordance with the present invention, there is provided an electric motor control means wherein said first and third connectors comprises said male elements and said second and fourth connectors comprises said female elements.

The switch may be chosen from a group of switches of different type. The chosen switch means may be one of the following: standard, illuminated, electronic or group function unit push button type, standard, illuminated, electronic or group function unit rotary type, standard, illuminated, electronic or group function unit selector, type or any other known switch means.

The electromechanical component means may be chosen from a group of electromechanical means of different type. The chosen electromechanical means may be one of the following: magnetic or electric motor starter.

DESCRIPTION OF THE DRAWINGS

These and many objects and advantages of the subject invention will be readily apparent to one skilled in the art to which the invention pertains from the claims and from the following detailed description when read in conjunction with the appended drawings, in which:

DETAILED DESCRIPTION OF A PREFERRED EMBODIMENT

Figure 1:
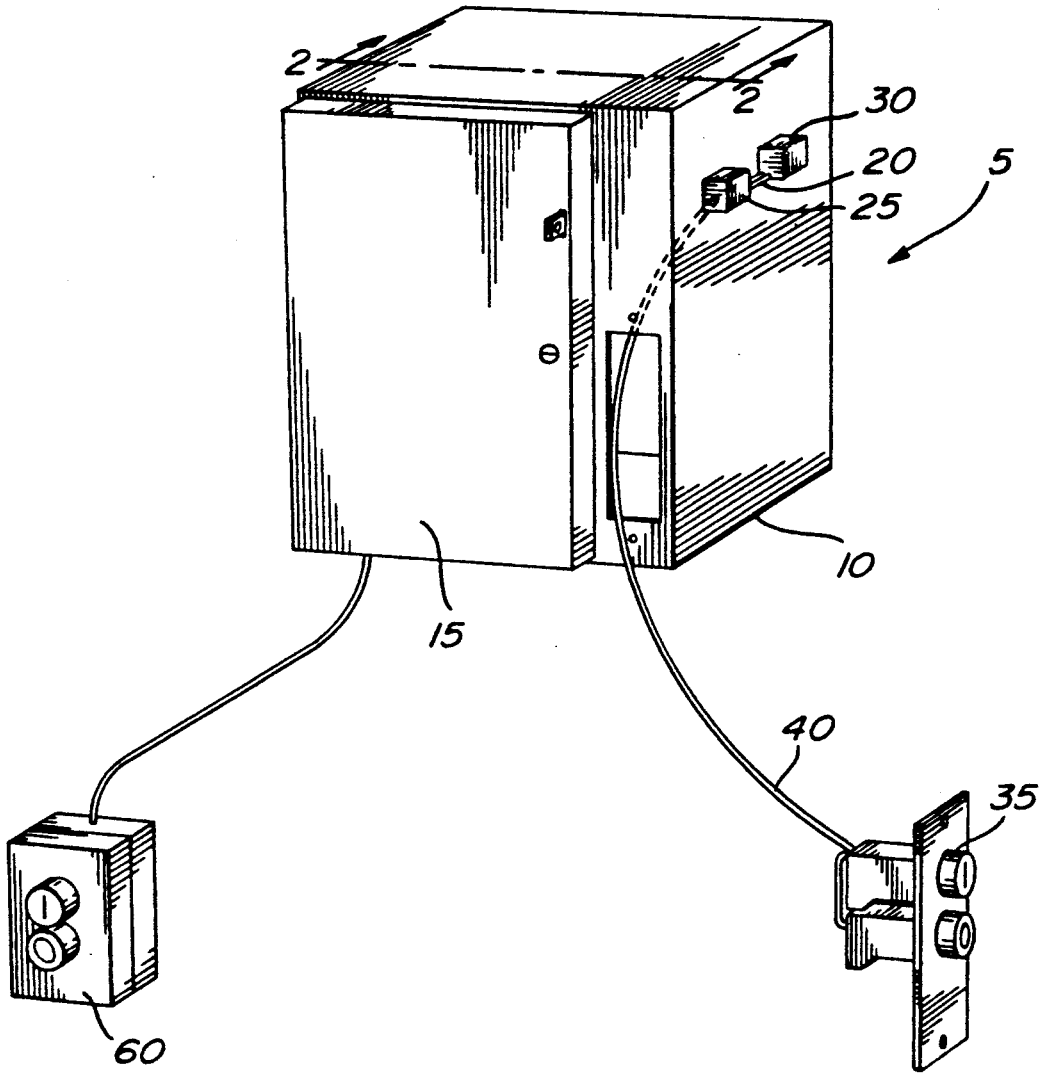
FIG. 1 is a partially exploded perspective view of an electrical or electronical control in accordance to the present invention.

FIG. 1 shows the overall configuration of the control 5 of the present invention. It comprises a conventional control box 10 having a door 15 which can be locked or otherwise closed, a first multiple pin connector 20, comprising a male connector 25 and a female connector 30 adapted to be matably connected together, a switch means 35, a cable 40 extending between said switch means 35 and said first multiple pin connector 20 and finally an electromechanical component 45 (shown in FIG. 2) connected to said female connector 30 of the first multiple pin connector 20.

The control box 10 can be fixed to any appropriate surface such as a wall or the like by means of mounting bracket 50 (FIG. 2) and can be made of dielectric material.

In a preferred embodiment, the female connector 30 and the male connector 25 of the first multiple pin connector 20 are connected together. However, in another embodiment (shown in FIG. 3), it is possible to add a second multiple pin connector 55 connected to a second switch means 60 to remotely control the electromechanical component 45 (see FIG. 2). This second connector 55 is provided with the same male/female connectors and is interposed between the male connector 25 and the female connector 30 of the first multiple pin connector 20. This second embodiment is schematically shown in FIG. 3. In FIG. 3, the first switch means 35 is referred to as "LOCAL SWITCH" and the second switch means 60 as the "REMOTE SWITCH" (schematically illustrated).

In the embodiment shown, the first switch means 35 comprises a conventional switch actuator in the form of a start/stop switch 65. The switch means may also optionally comprise a pilot lamp 70.

Figure 3:
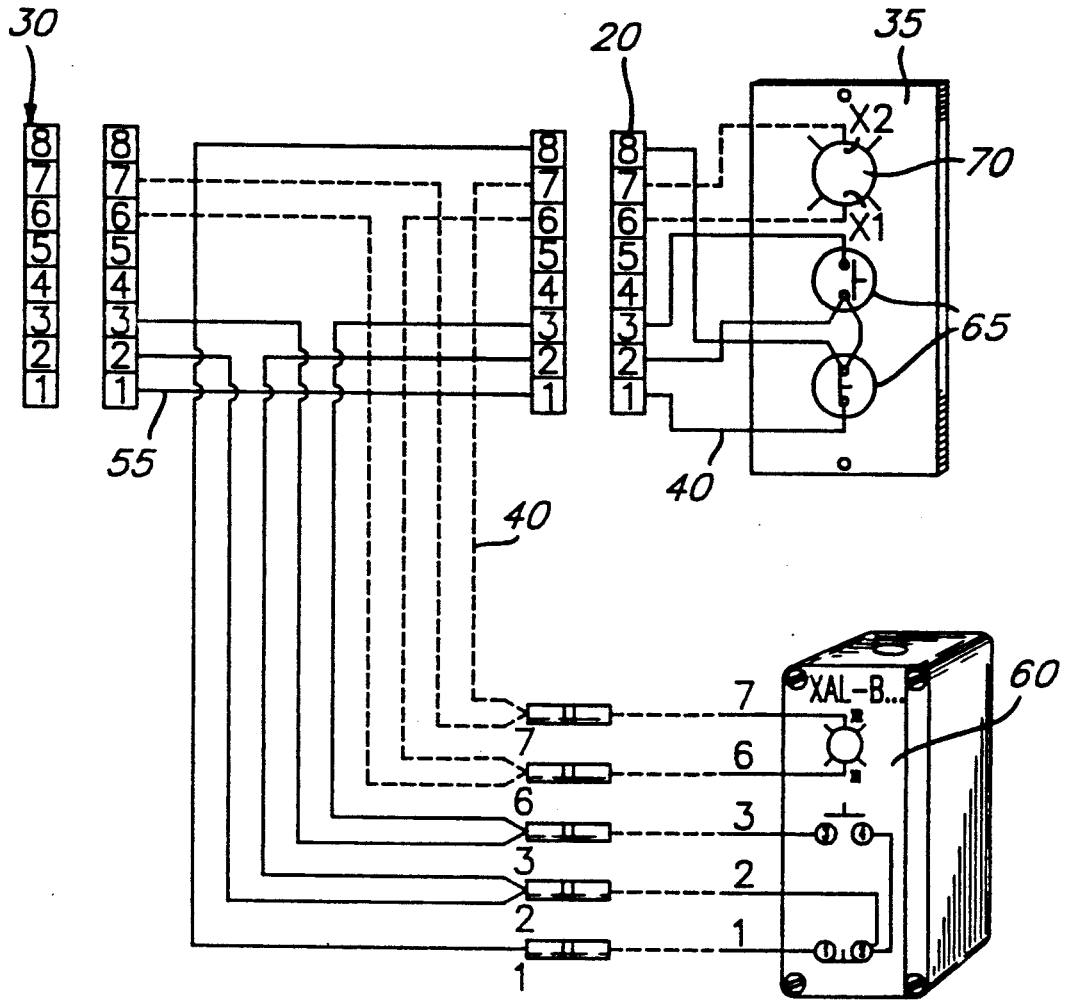
FIG. 3 is a schematic wiring diagram of the embodiment shown in FIG. 1 showing the optional use of a pilot lamp.
Figure 4:
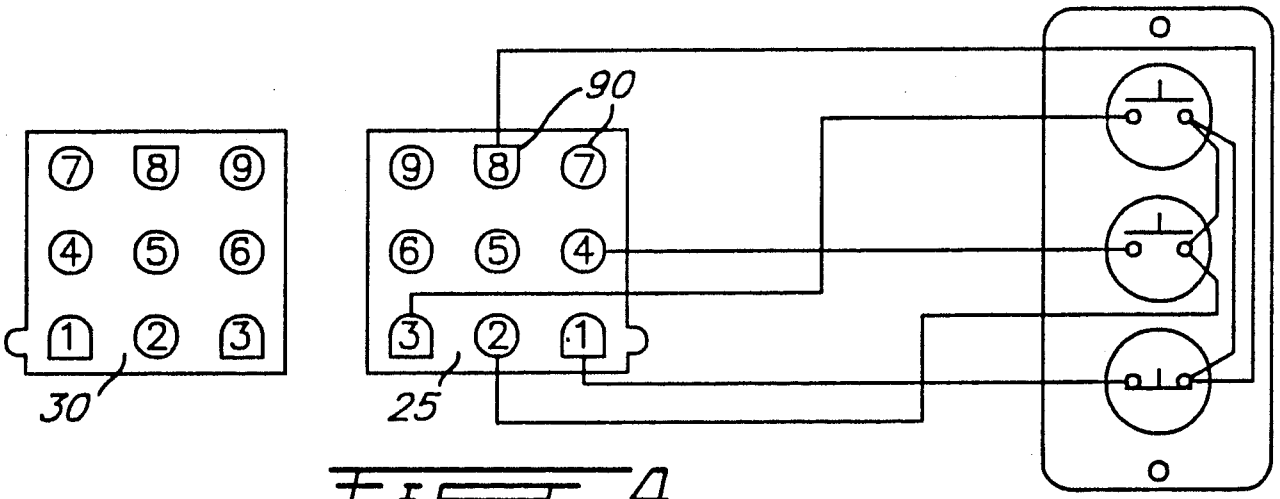
FIGS. 4 to 7 show different switch means for the present invention.
Figure 5:
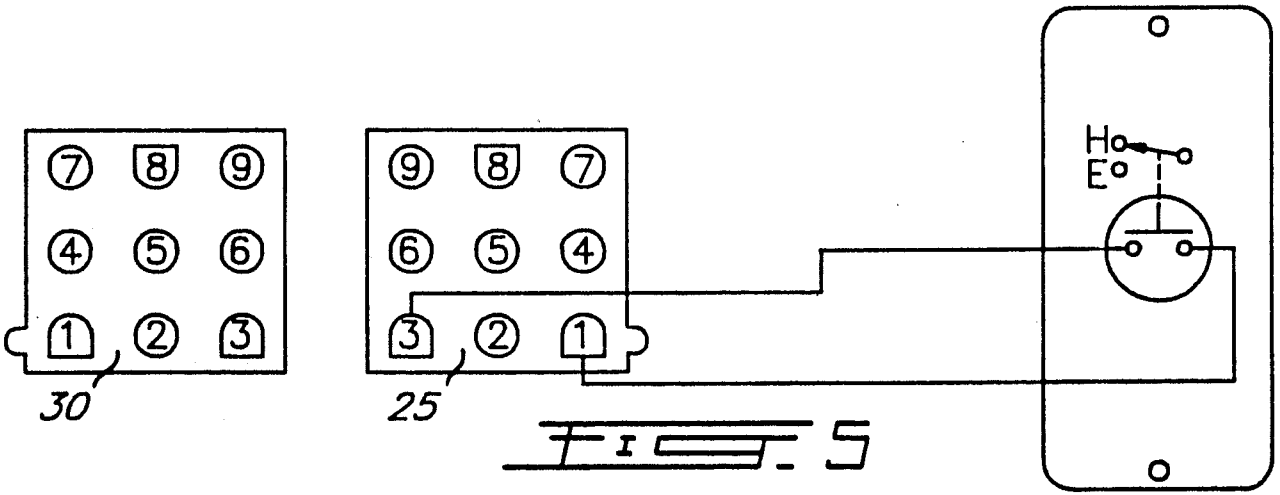
Figure 6:
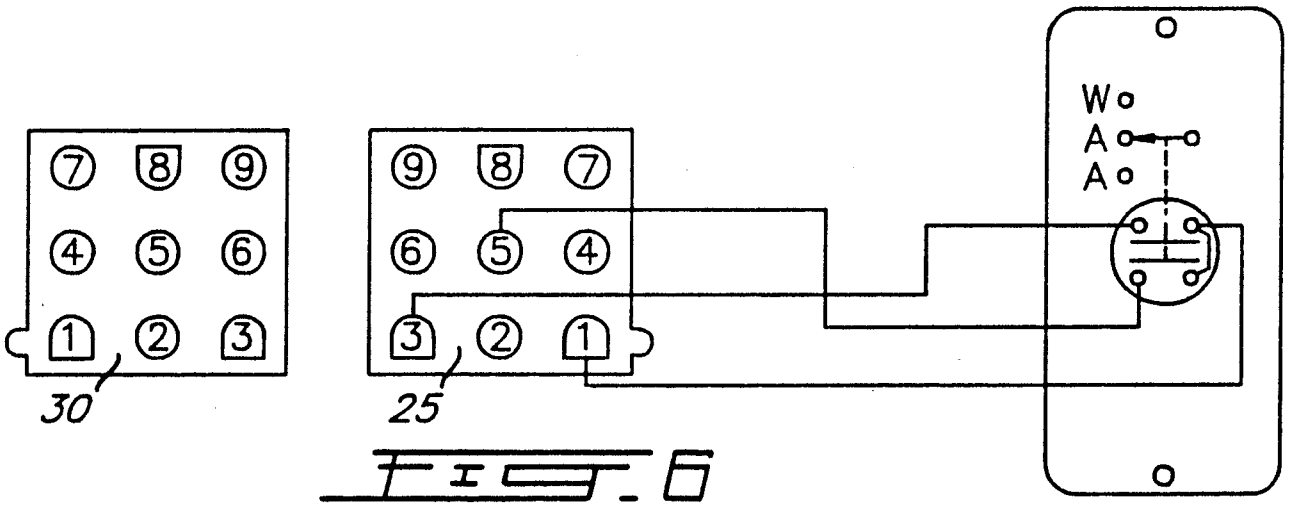
Figure 7:
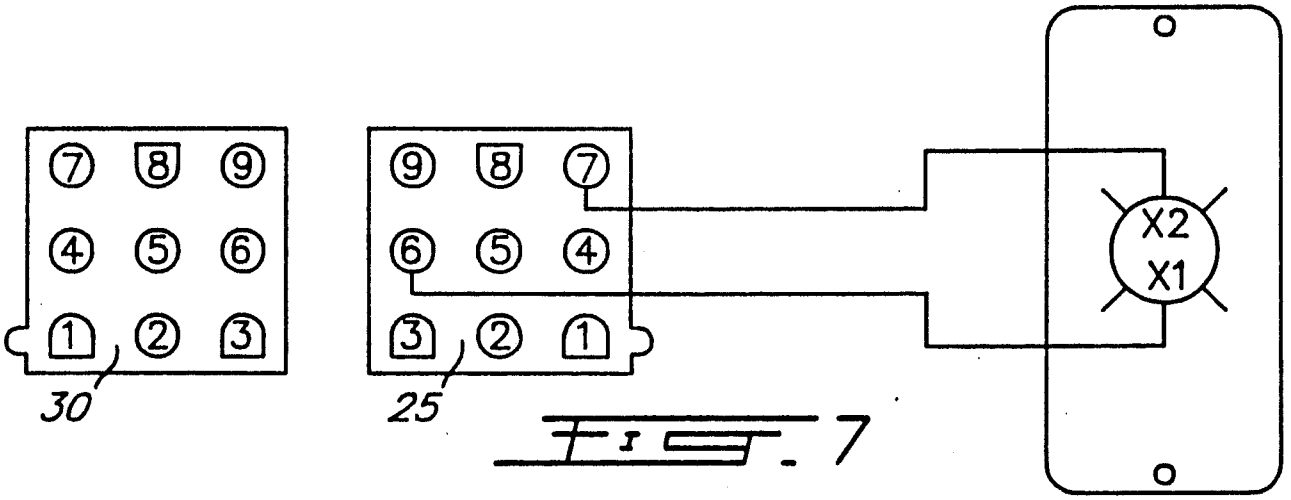

FIGS. 4–7 show different configurations of switch means and the corresponding wiring diagram of the multiple pin connector. Each of the connectors used comprises nine pins 90. FIG. 4 is a forward/reverse switch means 80 comprising a stop switch. In this configuration, only pins 1, 2, 3 and 8 are used. FIG. 5 shows a simple on/off rotary switch means 85 wherein only pins 1 and 3 are used. FIG. 6 shows a more complex on/off rotary switch using pins 1, 3 and 5. FIG. 7 is a pilot lamp similar to the one shown in FIG. 3 wherein pins 6 and 7 are used. It will be understood that the configurations shown in FIGS. 4 to 7 are for illustration purposes and should not be interpreted as limiting the application of the present invention to those switches or to the particular connections shown.

As explained earlier, all switches shown in FIGS. 4 to 7 are, according to the present invention, wired at the factory in accordance with a standardized configuration, that is, knowing what will be the pins 90 of the male connector 25 in use for a particular switch. This standardized configuration is necessary to wire the female connector 30 of the first multiple pin connector 20 in such a way that the electromechanical component will perform in a desired manner.

Figure 2:
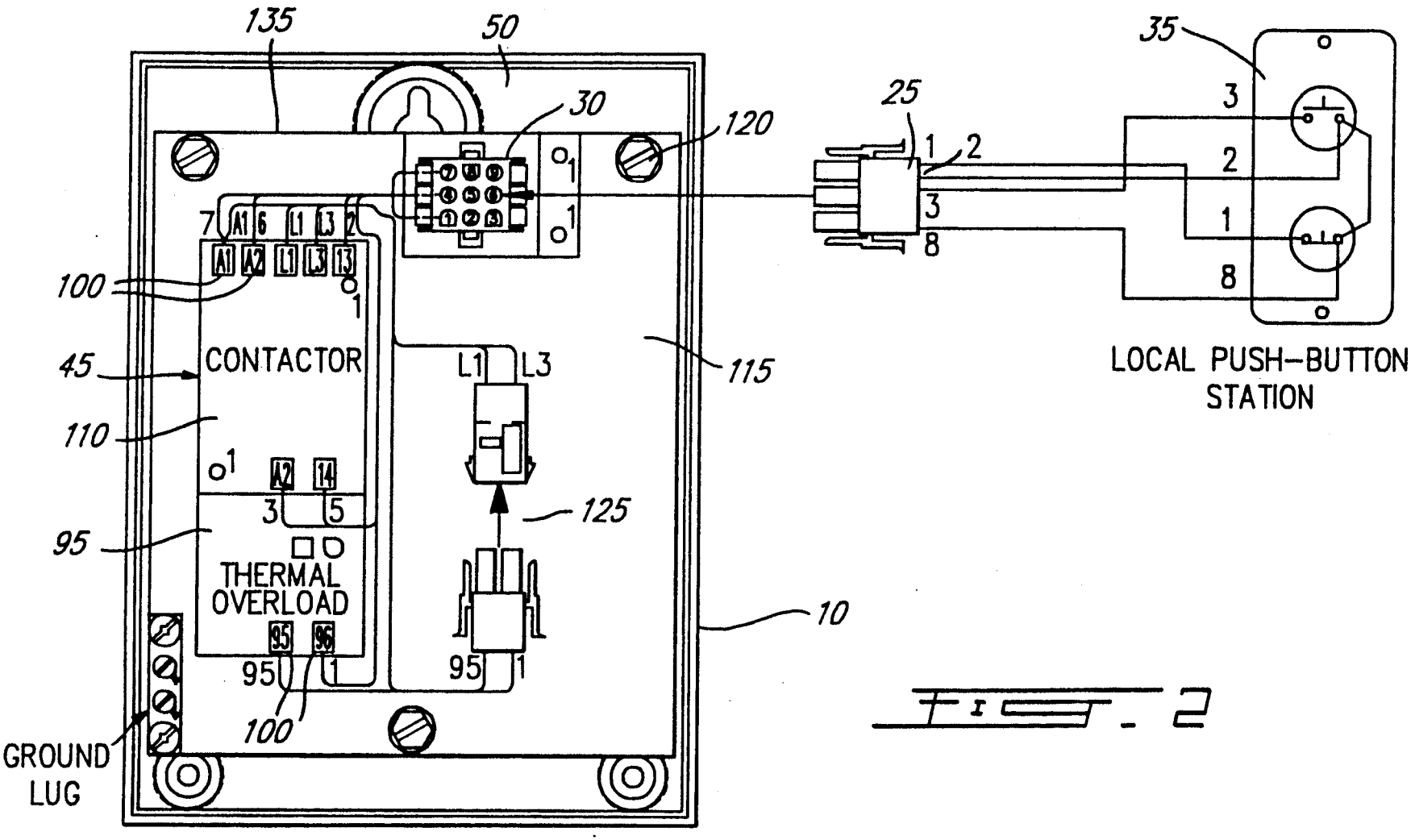
FIG. 2 is a cross-sectional view along line 2—2 of the electromechanical means of FIG. 1 and a schematic view of the switch means of FIG. 1.

Referring to FIG. 2, a schematic installation is seen forming the basis of the present invention. This installation comprises the electromechanical component 45 in the form of a contactor 110 and an optional thermal overload relay 95, each of which comprises a plurality of contacting posts 100 connected with a contacting screw (not shown) to the female connector 30 by means of an electrical wire. The contactor 110 and the thermal overload relay 95 are mounted to an insulating backplate 115 which is itself secured to the control box 10 by means of screws 120. The thermal overload relay 95 is then connected to the electrical or electronical motor (not shown).

In accordance with the present invention, a connection means may have a plurality of male elements. The plurality of male elements may comprise three groups of male elements, each of the groups of male elements comprising one or more male elements having the same configuration, the said same configuration being different from the configuration of the male elements of the other groups thereof.

The contactor 110 and the thermal overload relay 95, in the embodiment shown, are electrically connected by means a multiple pin connector 125 also comprising a male and a female connector. The thermal overload relay 95 is used as a safety mechanism which will cut the circuit continuity when the demand for current increases and reaches a predetermined value. This mechanism is of standard construction and therefore, same will not be further described.

Figure 3A:
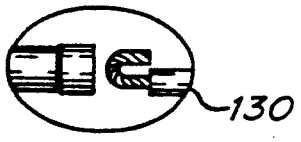
FIGS. 3*a* and 3*b* show example connections.
Figure 3B:
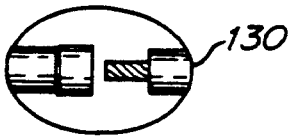

Cabling 40 extending between the switch means 35 and the first or second multiple pin connector 20 or 55 is connected in a conventional manner such as stripping said cabling to a predetermined length and inserting same into the multiple pin connector. For an illustration of such connection, see FIGS. 3*a* and 3*b* at 130.

To clearly illustrate the application of the present invention, an example will be hereinafter given. If the manufacturer receives an order, for a motor control using an on/off switch, it will have simply to take an on/off switch off the shelves, since said switch is already wired. Then, the control box 10 is completed by installing the insulating back plate 115 and by wiring the contactor 110 and the thermal overload relay (optional) 95. This wiring is achieved by properly connecting the cable 135 (see FIG. 2) extending between the female connector 30 to the corresponding contacting posts 100 on the contactor 110. This connection is simple since the contacting posts 100 are numbered in the same manner as the female 30 and male 25 connector.

Needless to mention that all this wiring is made at the factory. Thus, once on the premises, it is only necessary to install the switch means in the appropriate place and to connect the two connectors 25 and 30.

As many changes could be made in the above construction and method without departing from the scope of the invention, it is intended that all matter contained in the above description or shown in the accompanying drawings shall be interpreted as illustrative and not in a limiting sense, and it is also intended that the appended claims shall cover all such equivalent variation as come within the true spirit and scope of the invention.

We claim:

1. Electrical motor control means destined to achieve a predetermined function comprising in combination a first switch means, a second switch means, an electromechanical component means, a first multiple pin connection means comprising a first multiple pin connector and a second multiple pin connector, said first and second connectors being electrically connected respectively to said first switch means and said second switch means and a second multiple pin connection means comprising a third multiple pin connector and a fourth multiple pin connector, said third and fourth connectors being electrically connected respectively to said second switch means and said electromechanical means, said second connector being complementary to said first connector, said fourth connector being complementary to said third connector, wherein the connection of said first and said second connectors is unique such that only the appropriate pins of one of the pin connectors of the first multiple pin connection means are automatically electrically connected to the other pin connector of the first multiple pin connection means, and wherein the connection of said third and said fourth connectors is unique such that only the appropriate pins of one of the pin connectors of the second multiple pin connection means are automatically electrically connected to the other pin connector of the second multiple pin connection means.

2. Electric motor control means according to claim 1, wherein said electromechanical component means comprises an electric motor starter.

3. Electric motor control means destined to achieve a predetermined function comprising in combination a first switch means, a second switch means, an electromechanical component means, a first multiple pin connection means comprising a first multiple pin connector and a second multiple pin connector, said first and second connectors being electrically connected respectively to said first switch means and said second switch means and a second multiple pin connection means comprising a third multiple pin connector and a fourth multiple pin connector, said third and fourth connectors being electrically connected respectively to said second switch means and said electromechanical means, said second connector being complementary to said first connector, said fourth connector being complementary to said third connector, said first multiple pin connection means comprising a plurality of complementary male and female elements, at least one male element having a configuration different from the configuration of the other male elements of said first multiple pin connection means, said second multiple pin connection means comprising a plurality of complementary male and female elements, at least one male element having a configuration different from the configuration of the other male elements of said second multiple pin connection means, wherein the connection of said first and said second connectors is unique such that only the appropriate pins of one of the pin connectors of the first multiple pin connection means are automatically electrically connected to the other pin connector of the first multiple pin connection means, and wherein the connection of said third and said fourth connectors is unique such that only the appropriate pins of one of the pin connectors of the second multiple pin connection means are automatically electrically connected to the other pin connector of the second multiple pin connection means.

4. Electric motor control means according to claim 3, wherein said first and third connectors comprises said male elements and said second and fourth connectors comprises said female elements.

5. Electric motor control means according to claim 3, wherein said electromechanical component means comprises an electric motor starter.

* * * * *